United States Patent [19]

Tuckey et al.

[11] Patent Number: 4,951,636

[45] Date of Patent: Aug. 28, 1990

[54] CONSTANT PRESSURE-DIFFERENTIAL FUEL INJECTION SYSTEM

[75] Inventors: Charles H. Tuckey; James L. Thompson, both of Cass City; Brian K. Asselin, Caro, all of Mich.

[73] Assignee: Walbro Corporation, Cass City, Mich.

[21] Appl. No.: 276,801

[22] Filed: Nov. 28, 1988

[51] Int. Cl.[5] ..... F02M 39/00

[52] U.S. Cl. ..... 123/497; 123/41.31

[58] Field of Search ..... 123/497, 498, 499, 514, 123/468, 41.31, 456, 467, 463; 165/51, 41

[56] References Cited

U.S. PATENT DOCUMENTS

| | | | |
|---|---|---|---|
| 3,026,928 | 3/1962 | Phillips | 123/456 |
| 3,623,546 | 11/1971 | Banthin | 165/51 |
| 3,669,081 | 6/1972 | Monpetit | 123/497 |
| 3,699,931 | 10/1972 | Cinquegrani | 123/497 |
| 4,248,194 | 2/1981 | Drutchas | 123/497 |
| 4,260,333 | 4/1981 | Schillinger . | |
| 4,364,355 | 12/1982 | Karino | 123/41.31 |
| 4,557,225 | 12/1985 | Sagues | 123/41.31 |
| 4,649,884 | 3/1987 | Tuckey | 123/457 |
| 4,756,291 | 7/1988 | Cummins | 123/497 |
| 4,800,859 | 1/1989 | Sagisaka | 123/497 |

*Primary Examiner*—Carl Stuart Miller

*Attorney, Agent, or Firm*—Barnes, Kisselle, Raisch, Choate, Whittemore & Hulbert

[57] ABSTRACT

A fuel delivery system for internal combustion engines in which an electric-motor fuel pump supplies fuel under pressure to a fuel injector carried by the engine. An engine air intake manifold is likewise carried by the engine and supplied with combustion air. A pressure sensor is responsive to a pressure differential between the fuel injector and air manifold for controlling a pulse-width modulated drive signal applied to the fuel pump motor.

25 Claims, 2 Drawing Sheets

CONSTANT PRESSURE-DIFFERENTIAL FUEL INJECTION SYSTEM

The present invention is directed to fuel delivery systems for internal combustion engines, and more particularly to a fuel injection system comprising at least one fuel injector positioned between a pressurized fuel supply and an engine air intake manifold.

BACKGROUND AND OBJECTS OF THE INVENTION

In engine fuel delivery systems of current design, fuel is fed by a constant-delivery pump from a fuel tank to the engine, and excess fuel is returned from the engine to the fuel tank. Such return fuel carries engine heat to the fuel supply, and consequently increases temperature and vapor pressure at the fuel supply. Venting of excess vapor pressure to the atmosphere not only causes pollution problems, but also deleteriously affects fuel mileage. Excess fuel tank temperature can also cause vapor lock at the pump, particularly where fuel level is relatively low. Constant pump operation also increases energy consumption while decreasing both pump life and fuel filter life.

U.S. Pat. No. 4,649,884 discloses a fuel injection system for an internal combustion engine in which an electric-motor constant-delivery fuel pump supplies fuel under pressure from a tank to a fuel rail positioned on the engine. Excess fuel is returned to the supply tank as a function of pressure differential between the fuel rail and the engine air intake manifold. A plurality of fuel injectors are mounted between the fuel rail and the engine air manifold, with the injector nozzles being positioned adjacent to the fuel/air intake ports of the individual engine cylinders. U.S. application Ser. No. 126,517, filed Nov. 30, 1987 and assigned to the assignee hereof, now U.S. Pat. No. 4,789,308 discloses a fuel delivery system for an internal combustion engine in which outlet pressure of an electric-motor fuel pump is monitored, and pump motor current is controlled as a function of such outlet pressure. Although the fuel delivery systems disclosed in the noted patent and application address the aforementioned problems in current fuel delivery system designs, further improvements remain desirable.

An object of the present invention, therefore, is to provide a fuel delivery system, particularly a fuel injection system of the type disclosed in the above-noted patent, that maintains constant pressure differential across the fuel delivery mechanism, specifically the fuel injectors, so that quantity of fuel supplied for a given injector activation time remains substantially constant and independent of fluctuations in air manifold pressure. Another object of the invention is to provide a pressure differential control system of the described character that is economical to implement in mass production of automotive fuel delivery systems, for example, and is reliable over an extended vehicle lifetime. A further object of the present invention is to provide a fuel delivery system of the described character that achieves on-demand fuel delivery, and thus reduces energy consumption while increasing pump and fuel filter operating lifetimes. Yet another object of the invention is to provide a fuel delivery system of the described character that reduces delivery of engine heat to the fuel tank, and thus reduces problems associated with fuel vaporization as hereinabove discussed. A further object of the invention is to provide a fuel delivery system that implements electronic control of the fuel pump as a function of fuel requirements, and in which the control electronics is cooled by fuel circulating in the delivery system.

SUMMARY OF THE INVENTION

In accordance with the present invention, the foregoing and other objectives are obtained by providing a fuel delivery system for an internal combustion engine that includes a fuel supply having an electric-motor fuel pump responsive to application of electrical power for delivering fuel under pressure. An engine air intake manifold supplies combustion air to the various engine cylinders, and at least one fuel injector is connected between the fuel supply and the air manifold. Pressure sensor mechanisms, preferably in the form of an integral differential pressure sensor, are responsive to pressure at the fuel injector and at the engine air manifold for supplying an electrical signal that varies as a function of pressure differential therebetween. The electric-motor fuel pump is driven as a function of such pressure differential, preferably by a pulse-width modulation amplifier for applying pulsed d.c. power to the motor at constant frequency, and at a duty cycle that varies as a function of the pressure differential signal. In this way, fuel pressure at the injector is automatically controlled so as to maintain a constant pressure differential across the injector between the fuel rail and the engine air manifold, to reduce volume of circulating fuel and thus engine heat delivered to the fuel tank, and to energize the fuel delivery pump as a function of fuel demand.

In the preferred embodiments of the invention, the pump control electronics, which may be either digital or analog in nature, is mounted on a printed circuitboard. The circuitboard is mounted on a body of heat conductive material having a passage through which circulating fuel is fed, so that the circulating fuel draws heat from and effectively cools the pump drive electronics. A check valve is positioned in the fuel return line to maintain fuel at the injector when the pump is not operating. In one embodiment of the invention, this check valve is mounted within the passage that extends through the electronics heat-sink body. This body may also contain a fuel pressure-pulse dampener in the form of a diaphragmed cavity open on one side to the fuel passage.

BRIEF DESCRIPTION OF THE DRAWINGS

The invention, together with additional objects, features and advantages thereof, will be best understood from the following description, the appended claims and the accompanying drawings which:

DETAILED DESCRIPTION OF PREFERRED EMBODIMENTS

Figure 1:
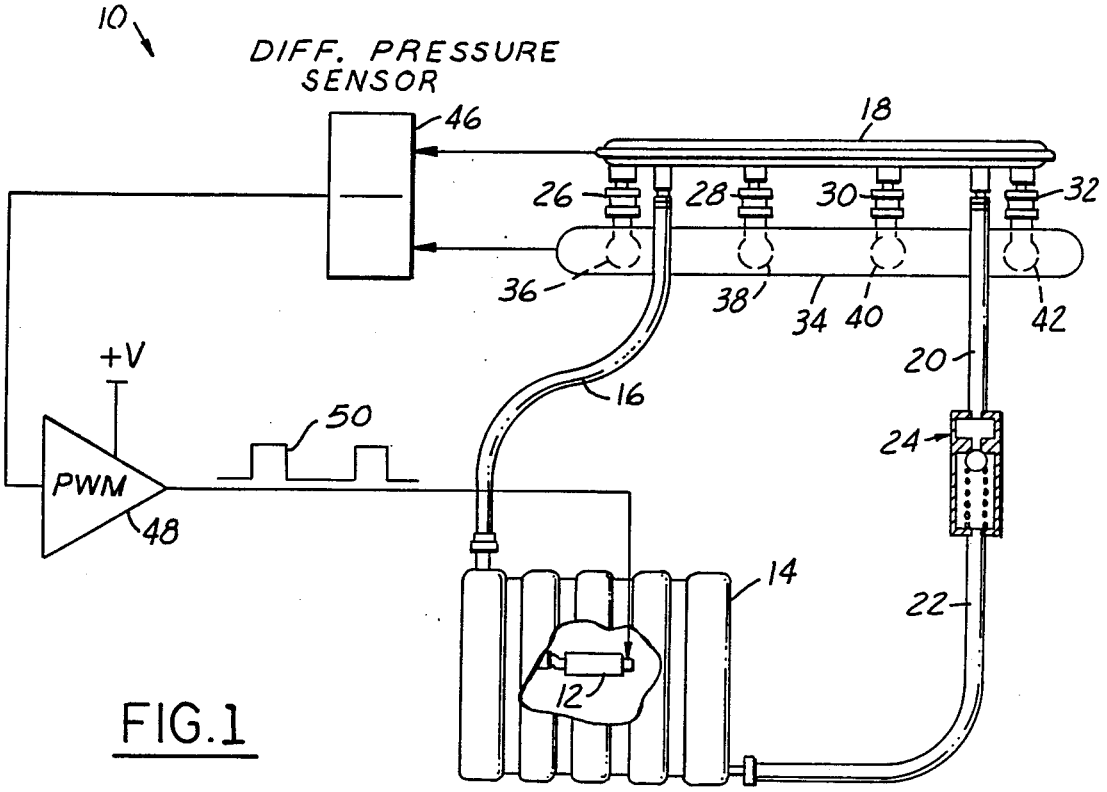
FIG. 1 is a schematic diagram of a fuel delivery system in accordance with one presently preferred embodiment of the invention.

FIG. 1 illustrates a fuel delivery system 10 in accordance with one presently preferred embodiment of the invention as comprising an electric-motor fuel pump 12 positioned within a fuel tank 14 for delivering fuel under pressure through a fuel line 16 to a fuel rail 18 carried on the engine (not shown). Excess fuel at rail 18 is returned to tank 14 through return lines 20, 22 and a fuel rail check valve 24. Check valve 24 maintains fuel in rail 18 when motor 12 is idle—i.e., when the engine is stopped. A plurality of fuel injectors 26, 28, 30 and 32 are mounted between rail 18 and an engine air intake manifold 34 carried by the engine, with the nozzles of the individual fuel injectors 26–32 being positioned adjacent to the fuel/air intake ports 36–42 of associated cylinders of the engine. To the extent thus far described, fuel delivery system 10 is disclosed in U.S. Pat. No. 4,649,884 noted above. Combustion air may be supplied to manifold 34 through an air filter or the like at atmospheric pressure, or by a turbocharger or the like driven by the engine and supplying air at pressure that varies with engine operation and/or throttle demand, etc. Injector 26–32 may be solenoid-activated, for example, by an on-board engine control computer, not shown.

In accordance with the present invention, a differential pressure sensor 46 receives a first input as a function of pressure within fuel rail 18, and a second input as a function of pressure within air manifold 34. Such inputs may be supplied by any suitable pressure delivery mechanisms. Sensor 46 supplies an electric signal as a function of the pressure differential between rail 18 and manifold 34. Such electrical pressure differential signal, which takes the form of an analog signal in the embodiment of FIG. 1, is fed to a pulse-width modulation amplifier 48. Amplifier 48 also receives d.c. electrical power from the vehicle electrical system, and supplies a pulse width modulated output signal 50 to energize the electric motor of pump 12. The pulse-width modulated output of amplifier 48 is preferably supplied at constant frequency and at a duty cycle that varies as a function, preferably an inverse linear function, of the pressure differential signal from sensor 46.

When pressure differential between rail 18 and manifold 34 is low, such as during periods of accelerated engine operation when fuel demand is high, the duty cycle of signal 50 is high. Thus, average d.c. power applied to pump 12 is high and the pump is energized accordingly. On the other hand, when pressure differential between rail 18 and manifold 34 is high, such as when the engine is idling and therefore has lower fuel demand, the duty cycle of the amplifier output is correspondingly low, and the fuel pump is energized at a lower level.

Figure 2:
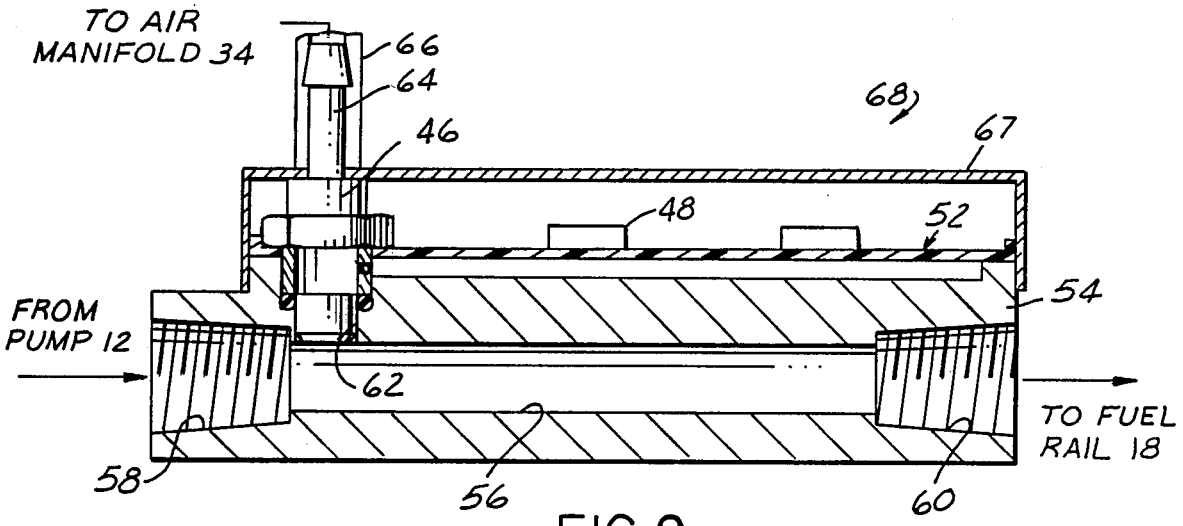
FIG. 2 is a sectioned elevational view of an enclosure for mounting the pump control electronics in the embodiment of FIG. 1.

FIG. 2 illustrates the pump control electronics, including pressure sensor 46 and amplifier 48, mounted as a printed circuitboard assembly 52 on a body 54 of heat conductive material construction, such as stainless steel. Body 54 has a passage 56 that extends therethrough, having an inlet opening 58 for receiving fuel from pump 12 and an outlet opening 60 for connection to fuel rail 18 (FIG. 1). Thus, body 54 is connected in line with fuel line 16 in FIG. 1, so that fuel circulating through line 16 draws heat from and effectively cools the pump control electronics. Differential pressure sensor 46 has one pressure input connected by a lateral passage 62 in body 54 to communicate with the main fuel passage 56, and a second pressure input connected by a nipple 64 and a hose 66 to air manifold 34 (FIG. 1). Assembly 52, including sensor 46, is enclosed by a cover 67 to form an integral package 68.

Figure 3:
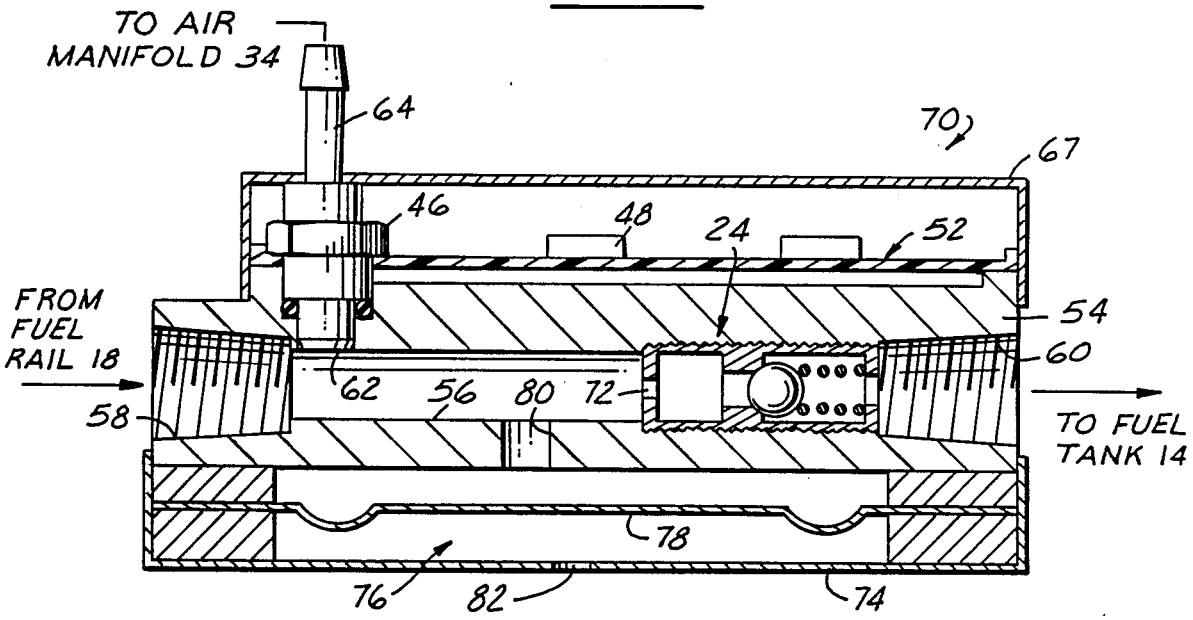
FIG. 3 is a sectioned elevational view of the pump control electronics enclosure in accordance with a modified embodiment of the invention.

FIG. 3 illustrates a modified embodiment 70 of the control package suitable for connection in return line 20, 22 (FIG. 1) between fuel rail 18 (FIG. 1) and fuel tank 14. In control package 70, check valve 24 is mounted within passage 56, as is a flow dampening orifice 72. A cover 74 cooperates with body 54 to form a chamber 76 that is divided by a diaphragm 78 of stainless steel construction or the like. The upper portion of chamber 76 is connected by a port 80 to fuel passage 56. The lower portion of chamber 76 is vented to atmosphere by an orifice 82 in cover 74. Thus, diaphragm 78 functions to dampen pressure fluctuations in the fuel delivery system.

Figure 4:
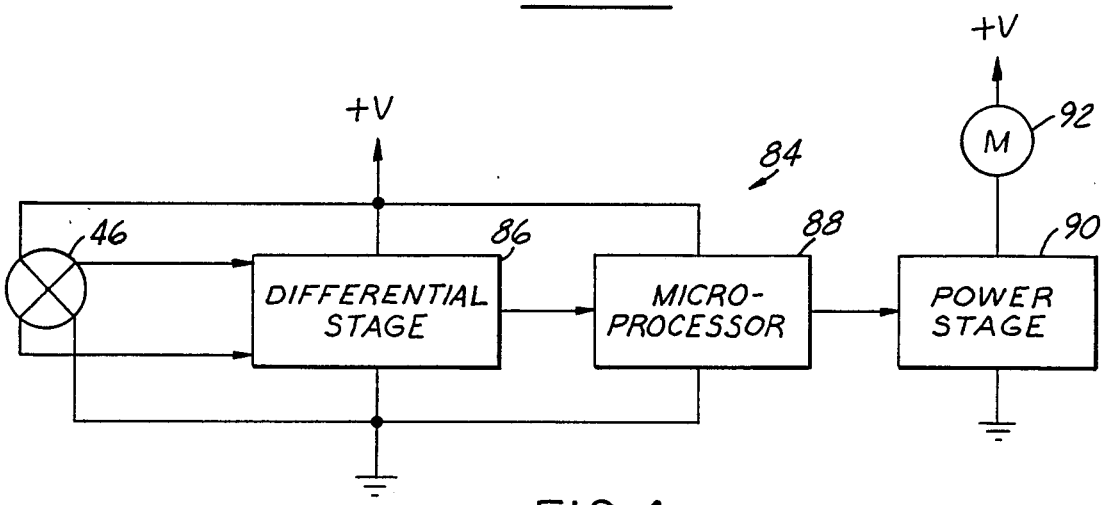
FIG. 4 is an electrical schematic diagram of digital pump control electronics in accordance with another embodiment of the invention.

FIG. 4 illustrates a digital embodiment 84 of the pump control electronics. Pressure sensor 46 is connected through a differential stage 86 to a microprocessor 88 that is suitably programmed to provide pulse-width modulated signal 50 (FIG. 1) to a power amplifier stage 90. Pump motor 92 is connected to power amplifier stage 90 for delivering fuel on demand as previously described.

Figure 5:
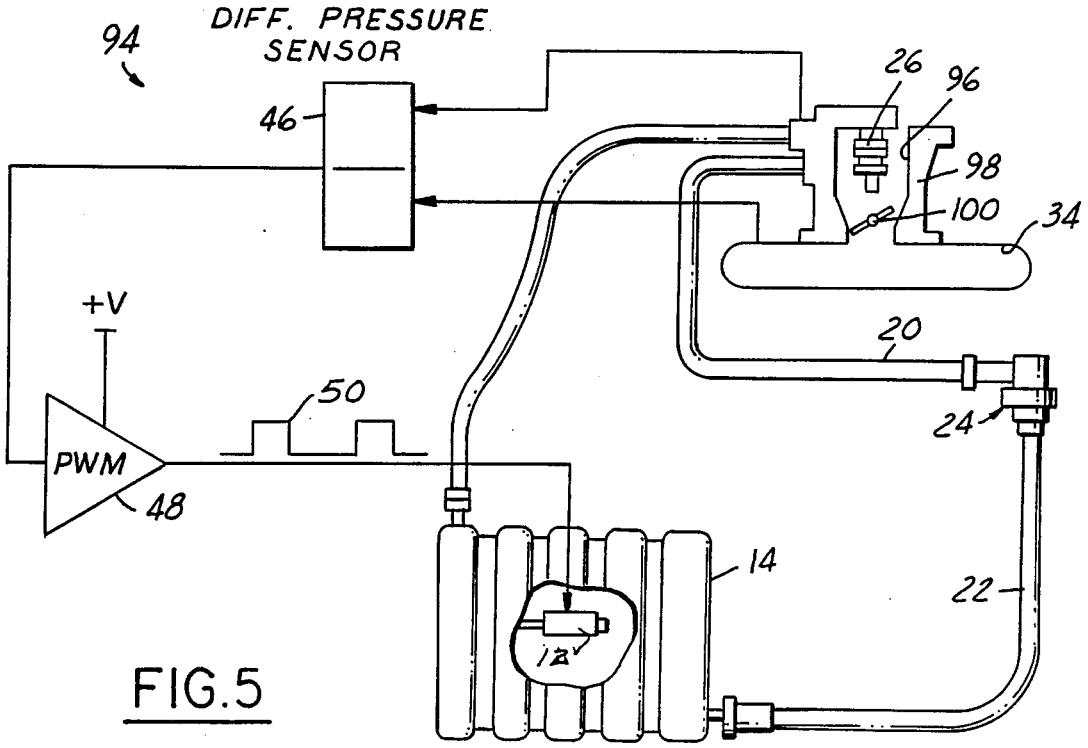
FIG. 5 is a schematic diagram of a modified fuel delivery system in accordance with yet another preferred embodiment of the invention.

FIG. 5 illustrates a modified fuel delivery system 94 in accordance with yet another preferred embodiment of the invention in which a single fuel injector 26 is positioned within the central passage 96 of a throttle body 98 for delivering fuel past the throttle valve 100 to engine air intake manifold 34. Fuel delivery system 94 in FIG. 5 is otherwise identical to system 10 of FIG. 1.

There have thus been disclosed several embodiments of a fuel delivery system that fully satisfies all of the objects and aims previously set forth. The fuel pump is energized on demand, as distinguished from constant-delivery fuel pumps characteristic of the prior art, thus reducing energy consumption and increasing both pump life and the operating life of the fuel filter (not shown). Because the fuel pump is energized only on demand, volume of circulating fuel returned to the fuel tank is greatly reduced, thus decreasing delivery of heat to the fuel tank. Consequently, problems associated with fuel vaporization are likewise reduced. Although the invention has been described in conjunction with presently preferred embodiments thereof illustrated in the drawings, it will be appreciated that many alternatives and modifications may be implemented without departing from the general principles of the invention. For example, differential pressure sensor 46, which preferably is provided in the form of an integral sensor unit of silicon or other solid state construction, could take the form of separate electrical or mechanical sensors whose outputs are fed to a differential amplifier or the like. Other types of electrically-powered fuel pumps may be employed, such as a mechanical fuel pump whose output is modulated by an electronic solenoid valve. Likewise, although pulse width modulation of the pump drive voltage is presently preferred, frequency modulation or d.c. current or voltage control could also be employed.

The invention claimed is:

1. A fuel delivery system for an internal combustion engine that includes a fuel supply with a fuel pump responsive to application of electrical power for delivering fuel under pressure, an engine manifold, fuel delivery means coupled to said fuel supply for controlled delivery of fuel from said supply to said manifold, means for returning excess fuel from said fuel delivery means to said supply, a body of heat conductive construction having a fuel passage extending therethrough connected in said fuel-returning means, and means for applying electrical power to said pump comprising:

orifice means in said fuel-returning means for restricting flow of fuel therethrough and thereby developing a back pressure of fuel in said fuel-returning means, pressure sensing means coupled to said fuel-returning means between said orifice means and said fuel delivery means for supplying an electrical pressure signal as a function of said back pressure, and means for applying electrical power to said pump as an inverse function of said pressure signal, said power-applying means including said pressure sensing means and said orifice being mounted on said body such that fuel passing through said body cools said power-applying means.

2. A fuel delivery system for an internal combustion engine that includes a fuel supply with a fuel pump responsive to application of electrical power for delivering fuel under pressure, an engine air intake manifold including means for supplying combustion air to said manifold, fuel delivery means coupled to said fuel supply for controlled delivery of fuel from said supply to said manifold, and means for applying electrical power to said pump; characterized in that said power-applying means comprises:

differential pressure sensor means having a first input coupled to said fuel supply and responsive to fuel pressure delivered to said fuel delivery means, a second input coupled to said engine manifold and responsive to air pressure in said manifold, and an output for supplying an electrical sensor signal that varies as a direct continuous function of a pressure difference between said first and second inputs, and means responsive to said signal for applying electrical power to said pump as a continuous inverse function of said pressure difference so as to maintain a substantially constant pressure differential across said fuel delivery means through controlled variation of pump speed.

3. The system set forth in claim 2 wherein said power-applying means further includes means responsive to said electrical signal for applying pulse-width modulated d.c. power to said pump at constant frequency and at a duty cycle that varies as a function of said pressure difference.

4. The system set forth in claim 2 further comprising means for returning excess fuel from said fuel delivery means to said supply, characterized in that said fuel-returning means includes a check valve for maintaining fuel at said fuel delivery means in the absence of operation of said pump.

5. The system set forth in claim 2 further comprising a body of heat conductive construction having a fuel passage extending therethrough connected between said fuel supply and said fuel delivery means, said power-applying means being mounted on said body such that fuel passage through said body cools said power-applying means.

6. The system set forth in claim 5 wherein said pressure differential sensor means comprises a sensor mounted on said body and having said first input open to said passage, and means connecting said second input of said differential pressure sensor to said engine manifold.

7. The system set forth in claim 6 wherein said power-applying means further includes means for applying pulse-width modulated d.c. power to said pump at constant frequency and at a duty cycle that varies as a function of said pressure difference.

8. The system set forth in claim 7 wherein said power-applying means, including said sensor and said sensor responsive means, comprise a printed circuitboard assembly mounted on said body.

9. The system set forth in claim 5 further comprising means for returning excess fuel from said fuel delivery means to said supply, characterized in that said fuel-returning means includes a check valve for maintaining fuel at said fuel delivery means in the absence of operation of said pump.

10. The system set forth in claim 9 wherein said check valve is disposed in said body passage.

11. The system set forth in claim 10 further comprising a fuel flow :dampening orifice in said passage.

12. The system set forth in claim 5 further comprising means mounted on said body for dampening pressure fluctuations in fuel flowing through said passage.

13. The system set forth in claim 12 wherein said pressure-dampening means comprises a cavity in said body, a diaphragm dividing said cavity into first and second chambers, a first port connecting said first chamber to said passage, and a second port venting said second chamber to atmosphere.

14. The system set forth in claim 2 wherein said fuel delivery means comprises a fuel rail coupled to said pump and at least one fuel injector connected between said fuel rail and said manifold.

15. The system set forth in claim 2 wherein said fuel delivery means comprises a throttle body having a passage for delivering air to said manifold, and a fuel injector coupled to said pump and mounted to inject fuel into said passage.

16. The system set forth in claim 2 wherein said pump comprises an electric-motor fuel pump.

17. The system set forth in claim 1 said power-applying means comprises a pulse width modulating amplifier responsive to said pressure signal for applying modulated d.c. power to said pump at constant frequency and at a duty cycle that varies as a function of said signal.

18. The system set forth in claim 17 wherein said power-applying means, including said sensor and said signal-responsive means, comprises a printed circuitboard assembly mounted on said body.

19. The system set forth in claim 18 wherein said orifice means comprises means mounted within said body passage.

20. A fuel delivery system for an internal combustion engine that includes a fuel supply with a fuel pump responsive to application of electrical power for delivering fuel under pressure, an engine air intake manifold including means for supplying combustion air to said manifold, fuel delivery means coupled to said fuel supply for controlled delivery of fuel from said supply to said manifold, a body of heat conductive construction having a fuel passage extending therethrough connected between said fuel supply and said fuel delivery means, and means for applying electrical power to said pump comprising:

first means coupled to said fuel supply and responsive to fuel pressure delivered to said fuel delivery means, second means responsive to a reference air pressure, and means for applying electrical power to said pump as a function of a difference in pressure between said first and second means, said power-applying means including said first and second means being mounted on said body such that fuel passing through said body cools said power-applying means.

21. The system set forth in claim 20 wherein said first and second means comprise a differential pressure sensor mounted on said body and having a first input open to said passage, and means connecting a second input of said differential pressure sensor to said reference air pressure.

22. The system set forth in claim 21 wherein said power-applying means, including said sensor and said sensor-responsive means, comprise a printed circuit-board assembly mounted on said body.

23. The system set forth in claim 21 wherein said power-applying means further includes means for applying pulse-width modulated d.c. power to said pump at constant frequency and at a duty cycle that varies as a function of said pressure difference.

24. The system set forth in claim 22 further comprising means mounted on said body for dampening pressure fluctuations in fuel flowing through said passage.

25. The system set forth in claim 24 wherein said pressure-dampening means comprises a cavity in said body, a diaphragm dividing said cavity into first and second chambers, a first port connecting said first chamber to said passage, and a second port venting said second chamber to atmosphere.

* * * * *